United States Patent [19]

Dankman et al.

[11] 4,160,339

[45] Jul. 10, 1979

[54] TOY FLYING VEHICLE INCLUDING SOUND EFFECT GENERATOR

[76] Inventors: Scott Dankman; Richard C. Levy; Bryan McCoy, all of 1001 Spring St., Silver Spring, Md. 20910

[21] Appl. No.: 907,281

[22] Filed: May 18, 1978

[51] Int. Cl.[2] ..... A63H 27/00

[52] U.S. Cl. ..... 46/227; 46/232; 340/27 AT

[58] Field of Search ..... 46/74, 76 R, 76 A, 222, 46/232, 254; 340/27 A

[56] References Cited

U.S. PATENT DOCUMENTS

| | | | |
|---|---|---|---|
| 2,968,119 | 1/1961 | Glass et al. | 46/77 |
| 3,010,718 | 11/1961 | Pearson | 46/74 |
| 3,080,678 | 3/1963 | Girz | 46/232 |
| 3,162,980 | 12/1964 | Hellman | 46/232 |
| 3,339,307 | 9/1967 | Floyd et al. | 46/232 |
| 3,394,491 | 7/1968 | Valentine | 46/227 |
| 3,425,156 | 2/1969 | Field | 46/232 |
| 3,425,156 | 2/1969 | Field | 46/232 |
| 3,664,060 | 5/1972 | Longnecker | 46/232 |
| 3,839,822 | 10/1974 | Rexford | 46/232 |
| 3,994,282 | 11/1976 | Moulet | 46/232 |
| 4,009,464 | 2/1977 | Grimes et al. | 340/27 AT |
| 4,030,065 | 6/1977 | Bateman | 340/27 AT |

*Primary Examiner*—Louis G. Mancene
*Assistant Examiner*—Robert F. Cutting
*Attorney, Agent, or Firm*—Cushman, Darby & Cushman

[57] ABSTRACT

A toy flying craft including provisions for generating realistic engine whines in accordance with the attitude of the craft. Provisions for simulating weapons fire are also disclosed.

29 Claims, 2 Drawing Figures

TOY FLYING VEHICLE INCLUDING SOUND EFFECT GENERATOR

The present invention relates to toy flying craft, and in particular, a toy spacecraft which provides a realistic simulation of engine whine and weapons fire.

Realistic toys have always been much sought after by children. In particular, toys which simulate the sounds of a vehicle are particularly popular. In the past, however, toy flying craft have used mechanical noise generators which typically require friction with a ground surface for operation. Further, such mechanisms have not provided a simulated engine noise which varies realistically in accordance with the "operation" of the vehicle.

The present invention provides a toy flying craft which realistically simulates, through electrical means, the engine whine of the craft during periods of acceleration and deceleration. The engine whine is simulated by a multi-tone signal. The attitude (relative tilt) of the craft is sensed by, for example, a gravity operated switch within the flying craft body. When a tilt in a first direction is sensed, an engine noise signal is generated with ever increasing frequencies, to simulate acceleration until the craft "levels off". When the craft is tilted in a downward direction the frequencies of the engine noise simulation signal is steadily decreased to simulate deceleration, again until the craft is leveled off. When the craft is in an untilted attitude, the frequencies of the engine noise simulation signal is maintained constant. Provisions are also included to selectively simulate the firing of laser-like weapons.

Figure 1:
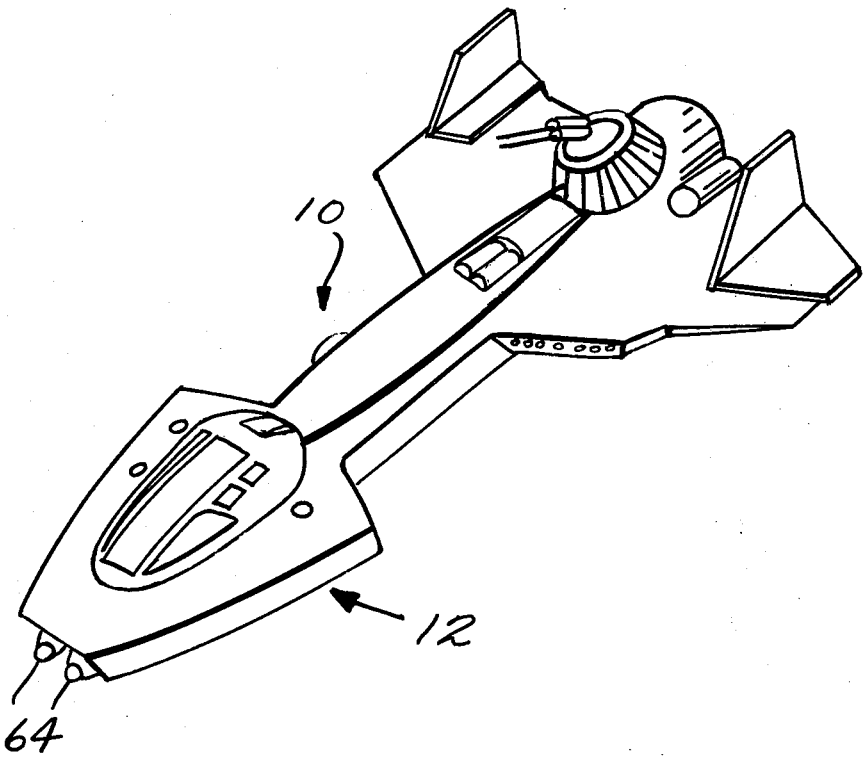
Figure 2:
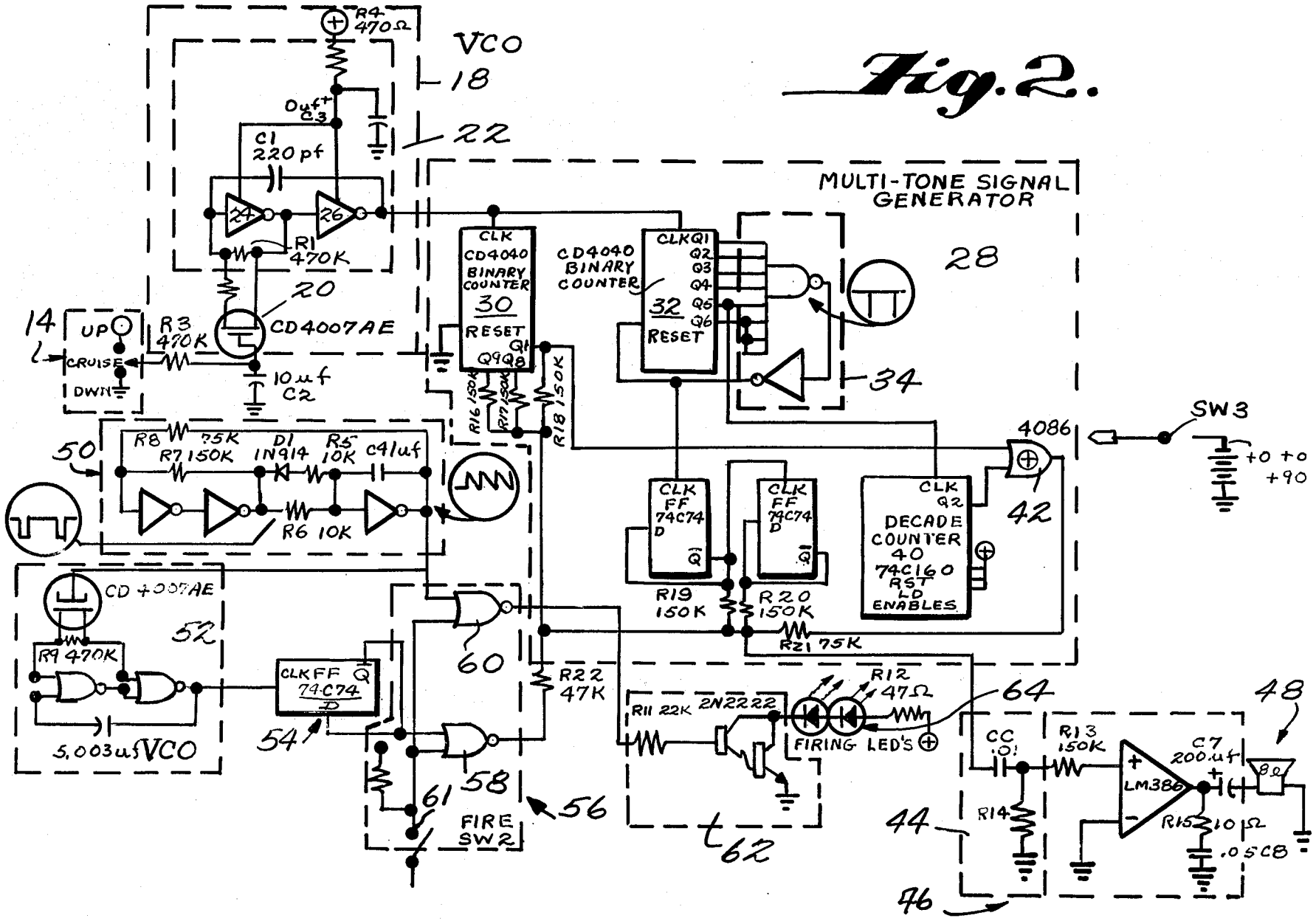

A preferred exemplary embodiment of the present invention will hereinafter be described in conjunction with the accompanying drawings wherein:

FIG. 1 is a pictorial representation of a toy flying craft in accordance with the present invention; and FIG. 2 is a schematic diagram of the preferred circuitry for generating the audio simulation.

Toy flying craft 10 comprises a body 12 of an appropriate size to be held by hand. Internal to body 12, a switch 14 is appropriately affixed. Switch 14 is suitably a center-off, gravity operated switch such as a mercury switch, or the like, which effects electrical connections in accordance with the attitude of body 12. More specifically, as shown in FIG. 2, switch 14 comprises a three position switch with a connecting element 16 coupled through a resistor R3 (suitably 470KΩ) to one terminal of a capacitor C2 (suitably 10mf). The other terminal of capacitor C3 is connected to ground potential.

Switch 14, capacitor C2 and resistor R3 cooperate to generate an electrical signal in accordance with the attitude of body 12. Switch 14 is affixed to body 12 such that when body 12 is tilted in a first direction, for example upward, an electrical connection is effected to a voltage source, to charge the capacitor C2 in accordance with the time constant established by R3 and C2, during such periods as body 12 is tilted upward. Similarly, when body 12 is tilted in a second direction, for example downward, an electrical connection is effected to ground potential such that any accumulated charge on capacitor C2 is dissipated in accordance with the R3 and C2 time constants. When the body 12 is maintained in an untilted attitude, capacitor C2 is effectively isolated, and the charge thereon is maintained until body 12 is again tilted.

The voltage developed across capacitor C2 is applied to a voltage controlled oscillator (VCO) 18. Voltage controlled oscillator 18 suitably comprises an NMOS field effect transistor 20, for example of the type contained in a National Semiconductor CD4007 chip, cooperating with a conventional cross-coupled inverter type oscillator 22 having a frequency determinative feedback resistance R1 and feedback capacitor C1. The gate of transistor 20 is coupled to capacitor C3 and the source and drain coupled across the frequency determinative resistive element R1 of oscillator 22. More specifically, oscillator 22 comprises two serially connected inverters, suitably of the National Semiconductor 74CD74 type, 24 and 26 respectively, having feedback provided from the output of inverter 26 to the input of inverter 24 through capacitive element C1 (suitably 220pf) and feedback from the output of inverter 24 to the input thereof through resistive element R1, which is suitably of the value 470KΩ. As is well known in the art, the time constant of R1 C1, in general, controls the nominal (center) frequency of oscillation of oscillator 22. NMOS transistor 20 operates as a variable resistance device, changing the effective feedback resistance in oscillator 22, and thus the frequency of operation, in accordance with the voltage developed across capacitor C2. Thus, VCO 18 provides an oscillation signal having a frequency ($f_{osc}$) in accordance with the attitude of body 12. The VCO oscillation frequency therefore continuously increases during periods when body 12 is tilted upward and capacitor C2 is charging. A further resistor R2 (suitably 10KΩ) is provided, cooperating with transistor 20, to establish a maximum frequency. Similarly, the oscillation frequency continuously decreases during such periods as craft body 12 is tilted downward and capacitor C2 is discharged. When the attitude of body 12 is untilted, the charge on capacitor C2 is maintained. Oscillator 18 thus provides a signal at a constant frequency, in accordance with the "level" whereat body 12 assumed an untilted attitude, to simulate cruising operation.

The oscillator output signal is applied to a multi-tone signal generator 28. Multi-tone signal generator 28 operates to provide an electrical signal having frequency components at a plurality of predetermined frequencies, which is utilized to simulate the sound of an engine. In general, multi-tone signal generator 28 provides an output signal having frequency components at $f_{osc}/2N$, $f_{osc}/4N$, $f_{osc}/8N$, $f_{osc}/4(N-1)$, and at frequencies substantially equal to the sum and difference of $f_{osc}/2N$ and $f_{osc}/2(N-1)$, ($f_{osc}(2N-1)/2N(N-1)$ and $f_{osc}/2N(N-1)$, respectively) where $f_{osc}$ is the instantaneous frequency of the oscillator and N is a predetermined constant. In the preferred exemplary embodiment here described, by way of non-limiting example, predetermined constant N is chosen to be 64. The predetermined relative frequency relationship of the components maintained constant throughout operation of the device, provides a realistic simulation of a jet engine whine, while the change in $f_{osc}$ with attitude simulates acceleration and deceleration of the engine.

More specifically, the VCO output signal is applied to the clock input terminals of respective binary counters, suitably of the National Semiconductor CD4040 type, 30 and 32 respectively. Binary counter 30 provides, at output terminals Q7, Q8 and Q9 thereof, a first set of tones; three squarewave signals having frequencies in accordance with the oscillator frequency but an octave apart, e.g., $f_{osc}/128$, $f_{osc}/256$ and $f_{osc}/512$, respectively.

A second set of tones is provided by counter 32, in cooperation with a conventional AND gate 31, and flip-flops 36 and 38. Output terminals Q1, Q2, Q3, Q4, Q5 and Q6 of binary counter 32 are coupled to the respective input terminals of a conventional AND gate 34 (in practice comprising a NAND gate and inverter), the output of which is, in turn, applied to the reset terminal of binary counter 32, to effect generation of a squarewave signal having a frequency equal to $f_{osc}/63$. The output terminal of AND gate 34 is also connected to the clock input terminal of a D-type flip-flop 36 suitably of the National Semiconductor 74C74 type. The $\bar{Q}$ output terminal of flip-flop 36 is tied to data terminal thereof. Flip-flop 36 thus operates as a divider and the $\bar{Q}$ output signal is at a frequency equal to $f_{osc}/126$. The $\bar{Q}$ output terminal of flip-flop 36 is also applied to the clock input of a further D-type flip-flop 38, connected to operate as a divider, to provide thereby a squarewave output signal having frequency equal to $f_{osc}/252$.

A further set of tones having frequencies indicative of the sum and difference of $f_{osc}/128$ and $f_{osc}/126$ are provided by a decade counter 40, suitably of the National Semiconductor 74C86 type. The Q5 output signal of binary counter 32 (providing an output signal having a frequency equal to $f_{osc}/31.5$) is applied to the clock input of decade counter 40. The Q2 output terminal of decade counter 40 is applied to one input of exclusive OR gate 42, while the other input terminal thereof is receptive of $f_{osc}/128$ frequency signals from output terminal Q7 of binary counter 30. Decade counter 40 operates, in effect, as a divide by 4 frequency divider to provide an output signal having frequency equal to $f_{osc}/126$. The output signal from terminal Q2 of counter 40 is thus at the same frequency as the output signal of flip-flop 38, but is out of phase therewith. The output signal from exclusive OR gate 42 contains signal components which are, in effect, the digital sum and difference of $f_{osc}/128$ and $f_{osc}/126$.

The respective squarewave signals from binary counter 30, flip-flops 36 and 38, and exclusive OR gate 42 are combined through a passive summer comprising resistors R16, R17, R18, R19, R20, each connected to a further resistor R21 (and R22 as will be explained). Resistors R16–R20 are each suitably of value 150KΩ and R21 is suitably of value 75KΩ. Resistor R22, as will be explained, is suitably of a value substantially less than resistors R16–R20, for example, 47KΩ.

The output of the summer, taken at the juncture of resistors R16–R20 and resistor R21, multi-tone signal is thus a multi-tone signal having a plurality of frequency components in constant predetermined frequency relationship, but which change in accordance with the attitude of body 12.

The multi-tone signal is applied through a suitable high pass filter 44 and therefrom through a conventional amplifier 46 to a speaker or other transducer 48. The resultant sonic (audio) output of transducer 48 simulates the sound of a jet engine. The multiple tones, in combination with the rather hard and distinct sounds provided by the sum and difference frequency components essentially duplicate the sound of a jet engine. Changes in frequency of the tones simulate acceleration and deceleration of the engine.

Toy flying craft 10 also includes provisions for simulation of weapons fire. A weapons fire simulation circuit comprising a modulation waveform generator 50, voltage controlled oscillator 52, flip-flop 54 and switch means 56 is coupled into the passive summer through resistor R22, and thus ultimately to transducer 48.

Modulation waveform generator 50 suitably comprises a conventional sawtooth voltage signal generator, the output thereof being applied to the control terminal of voltage controlled oscillator 52. Voltage controlled oscillator 52, similar to voltage controlled oscillator 18, but operating at a somewhat different nominal center frequency in accordance with the time constant of a feedback resistance R9 and feedback capacitance C5 (suitably in values 470KΩ and 0.003 μf). The output of oscillator 52 varies in frequency in accordance with the modulation waveform from generator 50. Output signals from oscillator 52, are thus, in effect, frequency modulated in accordance with the waveform generator 50 and are applied to flip-flop 54. Flip-flop 54 operates as a divide by 2 circuit and waveshaper and compensates for deviations from a 50% duty cycle in the modulated output of VCO 52. The output of flip-flop 54 is applied to one input of an 2 input NOR gate 58, the other input of which is coupled through a switch 61 to ground potential and through a resistor R10 (suitably of the value 10KΩ) to the voltage source. NOR gate 58 is inhibited during such periods as switch 61 is open, by the logic high (positive) voltage applied to the input terminal. Conversely, when switch 61 is closed, NOR gate 58 is enabled (with respect to the flip-flop output signal) by tying one input terminal of the NOR gate to ground potential. Thus, the output of flip-flop 54 is selectively passed to resistor R22 of the passive summer only during such times as switch 61 is closed. The frequency modulated signal to the passive summer through R22, by virtue of the relative values of R22 and resistors R16–R20, generates a louder audio output signal from transducer 48 than does the multi-tone engine simulation signal.

The modulation signal from generator 50 is also applied to one terminal of a two input NOR gate 60, the other input of which is also connected to switch 61 and resistor R10. The output of NOR gate 60 is applied to the driving circuitry 62 of one or more LED's 64 disposed on the exterior of body 12.

Modulation waveform generator 50, VCO 52, and flip-flop 54 cooperate to continuously provide a frequency modulated squarewave, which is selectively applied when switch 61 is closed to the passive summing network and thus ultimately to transducer 48 to simulate the sound of weapons fire. Simultaneously, the closing of switch 61 enables NOR gate 60 which applies the modulation waveform to driving circuitry 62 to LED's 64 which causes LED's 64 to illuminate in synchronism with the audio simulation to visually represent laser fire.

It should be appreciated that the present invention provides a particularly advantageous toy aircraft. The toy can be hand-held in simulation of flight. Tilting the craft in a first direction (upward) causes simulated acceleration of the engine. Tilting the craft in a second direction (downward) causes simulated deceleration. Holding the craft in an untilted attitude (level) simulates a cruising operation. In addition, weapons fire can be selectively simulated by manual closure of switch 61. Further additional flashing lights can be provided on the exterior of body 12.

It should also be appreciated that the circuitry shown in FIG. 2 is particularly advantageous in that it can readily be manufactured in the form of a unitary integrated chip.

As noted above, the preferred modulation waveform for weapons fire simulation is a sawtooth waveform, but other waveforms can be utilized. Similarly, the specific frequency relationship between the respective tones of the multi-tone engine simulation signal may be different from the specific relationship described above. Moreover, it will be understood that the above description is of an illustrative embodiment of the present invention, and that the invention is not limited to the specific forms shown. Modifications may be made in the design and arrangement of the elements without departing from the spirit of the invention as expressed in the following claims.

What is claimed is:

1. A toy flying craft comprising:

a body;

attitude sensing means, fixed to said body, for generating an electrical signal in accordance with the attitude of said body;

electronic means, responsive to said attitude signal for generating a multi-tone engine noise simulation signal having frequencies in accordance with said attitude; and transducer means responsive to electrical input signals applied thereto for generating audio representations of said input signals, said engine noise simulation signal being applied as an electrical input signal to said transducer means.

2. The toy of claim 1 wherein:

said attitude sensing means comprises:

a capacitor;

means for selectively establishing electrical connections to charge said capacitor at a predetermined rate during periods when said body is tilted in first direction;

means for establishing electrical connections to isolate said capacitor to thereby maintain the charge on said capacitor during periods when said body is maintained in an untilted attitude;

means for establishing electrical connections to discharge said capacitor at a predetermined rate during periods when said body is tilted in a second direction, whereby an attitude voltage is developed across said capacitor; and said means for generating said engine noise simulation signal comprises:

a voltage controlled oscillator responsive to said attitude voltage, for generating an oscillation signal;

digital means responsive to said oscillation signal for generating a plurality of tone signals in predetermined relative frequency relation at tone frequencies in accordance with the frequency of said oscillation signal; and means for combining said plurality of tone signals to generate said engine noise simulation signal.

3. The toy of claim 1 wherein said means for generating said engine noise simulation signal comprises:

oscillator means, responsive to said attitude signal, for generating an electrical oscillation signal of oscillation frequency in accordance with said attitude signal;

tone generator means, responsive to said oscillation signal, for generating a plurality of electrical squarewaves at respective tone frequencies in accordance with said oscillation frequency, said respective tone frequencies being in predetermined frequency relation;

means for generating further squarewaves having frequencies of predetermined substantially equal to the sum of and the difference of the frequencies of ones of said tone squarewaves; and means for combining said further squarewaves and the remainder of said tone squarewaves to generate said engine noise simulation signal.

4. The toy of claims 2 or 3, wherein said respective tone frequencies are spaced apart in frequency at one interval intervals.

5. The toy of claim 1 further including electronic means for selectively simulating weapons fire.

6. The toy of claim 5 wherein said electronic means for selectively simulating weapons fire comprises:

means for generating a modulation signal having a predetermined periodic waveform;

voltage controlled oscillator means, responsive to said modulation signal, for generating a squarewave signal at frequencies in accordance with said modulation signal; and means for selectively applying said squarewave signal as an input signal to said transducer means.

7. The toy of claim 6 wherein said electronic means for selectively simulating weapons fire further comprises:

a weapons fire simulation light, illuminating in response to control signals applied thereto;

means, cooperating with said means for selectively applying said squarewave signal, for selectively applying said modulating signal as a control signal to said weapons fire simulation light.

8. The toy of claims 6 or 7 wherein said predetermined waveform is a sawtooth waveform.

9. The toy of claim 2 wherein said digital means for generating said tone signals comprises:

means for generating first, second and third tone signals having instantaneous frequencies substantially equal to $\frac{1}{2}N$ times the instantaneous frequency of said oscillation signal, $\frac{1}{4}N$ times the instantaneous frequency of said oscillation signal, $\frac{1}{8}N$ times the instantaneous frequency of said oscillation signal, respectively, where N is a predetermined constant;

means for generating fourth and fifth tone signals having instantaneous frequencies substantially equal to $\frac{1}{2}(N-1)$ times the instantaneous frequency of said oscillation signal and $\frac{1}{4}(N-1)$ times the instantaneous frequency of said oscillation signal, respectively; and means for generating sixth and seventh tone signals having instantaneous frequencies substantially equal to the difference $((\frac{1}{2}(N-1)-(\frac{1}{2}N)0)$ times the instantaneous frequency of said oscillation signal and the sum $((\frac{1}{2}(N-1)+(\frac{1}{2}N))$ times the instantaneous frequency of said oscillation signal, respectively.

10. The toy of claims 3 or 9 wherein said means for combining comprises a passive summer.

11. The toy of claim 3 wherein said tone frequencies are substantially equal to $\frac{1}{2}N$ times the instantaneous frequency of said oscillation signal, $\frac{1}{4}N$ times the instantaneous frequency of said oscillation signal, $\frac{1}{8}N$ times the instantaneous frequency of said oscillation signal, $\frac{1}{2}(N-1)$ times the instantaneous frequency of said oscillation signal, $\frac{1}{4}(N-1)$ times the instantaneous frequency of said oscillation signal, $1/(2N(N-1))$ times the instantaneous frequency of said oscillation signal, and (2N-1)/(2N(N-1)) times the instantaneous frequency of said oscillation signal, respectively, where N is a predetermined constant.

12. The toy of claims 9 or 11 wherein said predetermined constant N is approximately 64.

13. The toy of claim 9 wherein said sixth and seventh tone signals are out of phase with at least some of said first, second, third, fourth and fifth tone signals.

14. A toy flying craft comprising:

a body;

means, fixed to said body, for generating a control signal;

electronic means, responsive to said control signal for generating a multi-tone engine noise simulation signal having frequencies in accordance with the magnitude of said control signal; and transducer means responsive to electrical input signals applied thereto for generating audio representations of said input signals, said engine noise simulation signal being applied as an electrical input signal to said transducer means.

15. The toy of claim 14 wherein:

said means for generating said control signal comprises;

a capacitor;

means for selectively establishing electrical connections to charge said capacitor at a predetermined rate during periods representative of one of an acceleration state and deceleration state of said toy flying craft;

means for establishing electrical connections to isolate said capacitor to thereby maintain the charge on said capacitor during periods representatve of a constant velocity state of said toy flying craft; and means for establishing electrical connections to discharge said capacitor at a predetermined rate during periods representative of the other of said acceleration state and deceleration state of said toy flying craft whereby said control signal is controllably developed across said capacitor.

16. The toy of claim 14 wherein said means for generating said control voltage comprises:

a capacitor; and a switch for selectively effecting electrical connections to said capacitor to controllably charge, discharge, and electrically isolate said capacitor to maintain constant the charge thereon, to generate thereby said control signal across said capacitor, the charging, discharging and constant charge state of said capacitor being representative of respective operative states of said toy flying craft engine.

17. The toy of claims 14, 15 or 16 wherein:

said means for generating said engine noise simulation signal comprises:

a voltage controlled oscillator responsive to said control signal for generating an oscillation signal;

digital means responsive to said oscillation signal for generating a plurality of tone signals in predetermined relative frequency relation at tone frequencies in accordance with the frequency of said oscillation signal; and means for combining said plurality of tone signals to generate said engine noise simulation signal.

18. The toy of claim 14 wherein said means for generating said engine noise simulation signal comprises:

oscillator means, responsive to said control signal, for generating an electrical oscillation signal of oscillation frequency in accordance with the magnitude of said control signal;

tone generator means, responsive to said oscillation signal, for generating a plurality of electrical squarewaves at respective tone frequencies in accordance with said oscillation frequency, said respective tone frequencies being in predetermined frequency relation;

means for generating further squarewaves having frequencies of predetermined substantially equal to the sum of and the difference of the frequencies of ones of said tone squarewaves; and means for combining said further squarewaves and the remainder of said tone squarewaves to generate said engine noise simulation signal.

19. The toy of claim 17 wherein said respective tone frequencies are spaced apart in frequency at one interval intervals.

20. The toy of claim 18 wherein said respective tone frequencies are spaced apart in frequency at one interval intervals.

21. The toy of claim 14 further including electronic means for selectively simulating weapons fire.

22. The toy of claim 22 wherein said electronic means for selectively simulating weapons fire comprises:

means for generating a modulation signal having a predetermined periodic waveform;

voltage controlled oscillator means, responsive to said modulation signal, for generating a squarewave signal at frequencies in accordance with said modulation signal; and means for selectively applying said squarewave signal as an input signal to said transducer means.

23. The toy of claim 22 wherein said electronic means for selectively simulating weapons fire further comprises:

a weapons fire simulation light, illuminating in response to control signals applied thereto;

means, cooperating with said means for selectively applying said squarewave signal, for selectively applying said modulating signal as a control signal to said weapons fire simulation light.

24. The toy of claims 22 or 23 wherein said predetermined waveform is a sawtooth waveform.

25. The toy of claim 17 wherein said digital means for generating said tone signals comprises:

means for generating first, second and third tone signals having instantaneous frequencies substantially equal to $\frac{1}{2}$N times the instantaneous frequency of said oscillation signal, $\frac{1}{4}$N times the instantaneous frequency of said oscillation signal, $\frac{1}{8}$N times the instantaneous frequency of said oscillation signal, respectively, where N is a predetermined constant;

means for generating fourth and fifth tone signals having instantaneous frequencies substantially equal to $\frac{1}{2}$(N-1) times the instantaneous frequency of said oscillation signal and $\frac{1}{4}$(N-1) times the instantaneous frequency of said oscillation signal, respectively; and means for generating sixth and seventh tone signals having instantaneous frequencies substantially equal to the difference $((\frac{1}{2}(N-1))-(\frac{1}{2}N))$ times the instantaneous frequency of said oscillation signal and the sum $((\frac{1}{2}(N-1))+(\frac{1}{2}N))$ times the instantaneous frequency of said oscillation signal, respectively.

26. The toy of claim 18 wherein said tone frequencies are substantially equal to ½N times the instantaneous frequency of said oscillation signal, ¼N times the instantaneous frequency of said oscillation signal, ⅛N times the instantaneous frequency of said oscillation signal, ½(N-1) times the instantaneous frequency of said oscillation signal, ¼(N1) times the instantaneous frequency of said oscillation signal, 1/(2N(N-1)) times the instantaneous frequency of said oscillation signal, and (2N-1)/(2N(N-1)) times the instantaneous frequency of said oscillation signal, respectively, where N is a predetermined constant.

27. The toy of claims 11, 17, 25 or 26 wherein said means for combining comprises a passive summer.

28. The toy of claim 25 or 26 wherein said predetermined constant N is approximately 64.

29. The toy of claim 25 wherein said sixth and seventh tone signals are out of phase with at least some of said first, second, third, fourth and fifth tone signals.

* * * * *

UNITED STATES PATENT AND TRADEMARK OFFICE

CERTIFICATE OF CORRECTION

PATENT NO. : 4,160,339

DATED : July 10, 1979

INVENTOR(S) : Scott Dankman

It is certified that error appears in the above-identified patent and that said Letters Patent are hereby corrected as shown below:

Column 6, line 12, "interval" should read --octave--

Column 8, lines 17 and 18 "interval" should read --octave--

Column 8, lines 20 and 21 "interval" should read --octave--

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*